US005097553A

United States Patent [19]

Boland

[11] Patent Number: 5,097,553

[45] Date of Patent: Mar. 24, 1992

[54] LEG SUPPORT FOR RELIEF OF BACK PAIN

[76] Inventor: Kevin O. Boland, 5623 Massachusetts Ave., Bethesda, Md. 20816

[21] Appl. No.: 730,606

[22] Filed: Jul. 16, 1991

[51] Int. Cl.[5] ..... A47G 9/00

[52] U.S. Cl. ..... 5/648; 5/362

[58] Field of Search ..... 5/431, 443, 444, 434, 5/436; 128/80 R; D6/601

[56] References Cited

U.S. PATENT DOCUMENTS

| | | | |
|---|---|---|---|
| D. 277,316 | 1/1985 | Meares | D6/601 |
| D. 289,354 | 4/1987 | Willey | D6/601 |
| D. 311,470 | 10/1990 | Cosgrove et al. | D6/601 |
| 830,776 | 9/1906 | Flagg | 5/443 |
| 4,502,170 | 3/1985 | Morrow | 5/443 |
| 4,627,423 | 12/1986 | Kampner | 5/443 |
| 4,635,306 | 1/1987 | Willey | 5/431 |
| 4,910,818 | 3/1990 | Grabill et al. | 5/443 |

OTHER PUBLICATIONS

"Comfort Wedge" A Trade Publication of Comfort Products, dated 3/84.

*Primary Examiner*—Alexander Grosz

[57] ABSTRACT

A device for supporting one's thighs, knees, calves, and feet to obtain relief and comfort from low back pain. The device permits the user to be placed in the correct position to strengthen the stomach muscles without risking injury to the back. When a prone user disposes his thighs at a 32 degree angle to the vertical, the lower spine is partially flattened and the lower back muscle tension is reduced. The curved areas of the support under the knees and heels, and in the same horizontal plane, provide a comfortable transition from the thigh supporting surfaces to the calf and foot supporting areas. The horizontal surface is depressed intermediate to its length and creates a final subtle incline to receive the calf muscles. The unit is customized to the user's leg length measurements.

6 Claims, 2 Drawing Sheets

LEG SUPPORT FOR RELIEF OF BACK PAIN

BACKGROUND OF INVENTION

There are many teachings in the prior art of products offering to relieve chronic and temporary back pain. Many of these products have appreciated the value of having the user lie face up with a device elevating the legs while maintaining knee flexion. The invention described herein is an improvement on these such devices. A good example of the prior art is Morrow, U.S. Pat. No. 4,502,170 granted Mar. 5, 1985. Morrow, although appreciating the advantages of inclining the front surface of a support to support the thighs, failed to appreciate the importance of providing full knee to foot support of the lower leg over rounded or peaked corners in a horizontal position.

FIELD OF INVENTION

This invention relates to the field of stationary mechanical devices that when used by a person having lower back problems will be instrumental in the relief of this back pain.

The invention provides low back relief while giving special attention to the support and comfort of one's knees, calves and feet. The device has two curved peaks, one for the knees and one for the heels. The curved elevation supporting the knees provides a comfortable transition from the vertical thigh support areas to the horizontal calf and foot supporting surfaces. The depression is gradual to provide adequate calf support resulting in a final peak supporting one's heels at an angle reducing calf tension.

The support of this invention assists users in maintaining a healthy and pain free lower back. By holding the user in the correct position, while doing limited sit-ups and/or stomach "crunches", the stomach muscles can be strengthened without risking injury to the back. Most doctors agree that strong stomach muscles are one of the best defenses against future low back problems.

Many back pain sufferers experiment by placing deflecting pillows and unyielding chairs beneath their legs to relieve pain. This invention is composed of a high density foam material providing needed support without compromising comfort.

The product is "user friendly" and easy to store. The invention comes in two pieces: the main support unit, which supports the lower buttocks, thighs, knees, calves and feet; and a one inch mat which supports the head and torso area. The device has a well located sturdy handle which makes the product easy to transport and store.

SUMMARY OF INVENTION

A principal objective of this invention is to provide a device to relieve lower back pain. The device obtains its objective by relaxing the muscles and ligaments of the lower back so as to ease tightness and discomfort.

Another objective of the invention is to provide support by having a pair of curved peaks on its upper surface for supporting the knees and heels respectively. These gently curved areas, together with the calf reception area enable users to enjoy increased muscle relaxation in the leg area.

A further objective of the invention is to provide a movable device that is easily transported and stored and that when used will help in the maintenance of a healthy and pain free lower back.

Another important objective of the invention is to provide a relatively inexpensive rugged device that can be readily fabricated for people in different size ranges.

Another objective of the invention is to provide a one inch pad to be used in association with the leg elevation member so that the torso and the legs are comfortably supported from head to foot.

A still further objective of the invention is to provide a device that has an inclined surface against which the buttocks and the thighs of the wearer are engaged so that the thighs will be at a relatively small angle from the vertical and another generally horizontal surface is provided to receive the lower leg.

Another important objective is to provide a device that supports the thighs at an angle to the vertical and supports the knees, heels and calves in an elevated position over a gently undulating surface. This body position permits the user to confidently perform modified sit-ups; that is, moving the torso toward the already inclined thighs.

These and other objectives of the invention will become more fully understood when reading the following specifications in view of the attach drawings.

A BRIEF DESCRIPTION OF THE DRAWINGS

FIG. 1—is an elevation showing the device in operation;

FIG. 2—is a perspective view of the invention with its associated pad;

FIG. 3—is a side view;

FIG. 4—is a rear view;

FIG. 5—is a front end view;

FIG. 6—is a plan view; and

FIG. 7—is a bottom view.

DESCRIPTION OF THE PREFERRED EMBODIMENT

Figure 1:
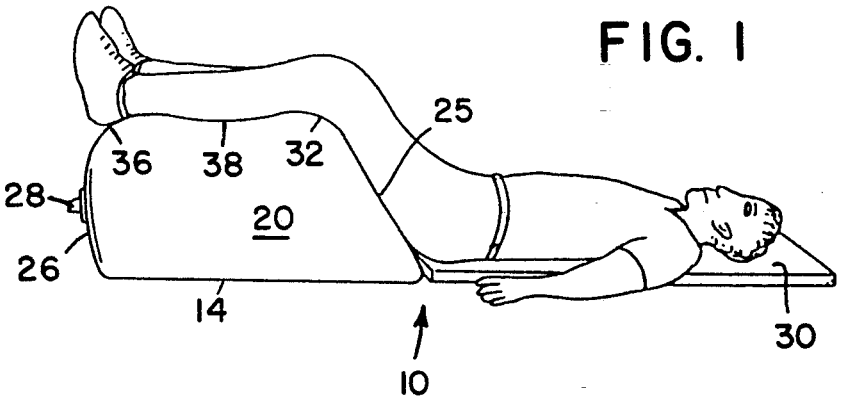
Figure 2:
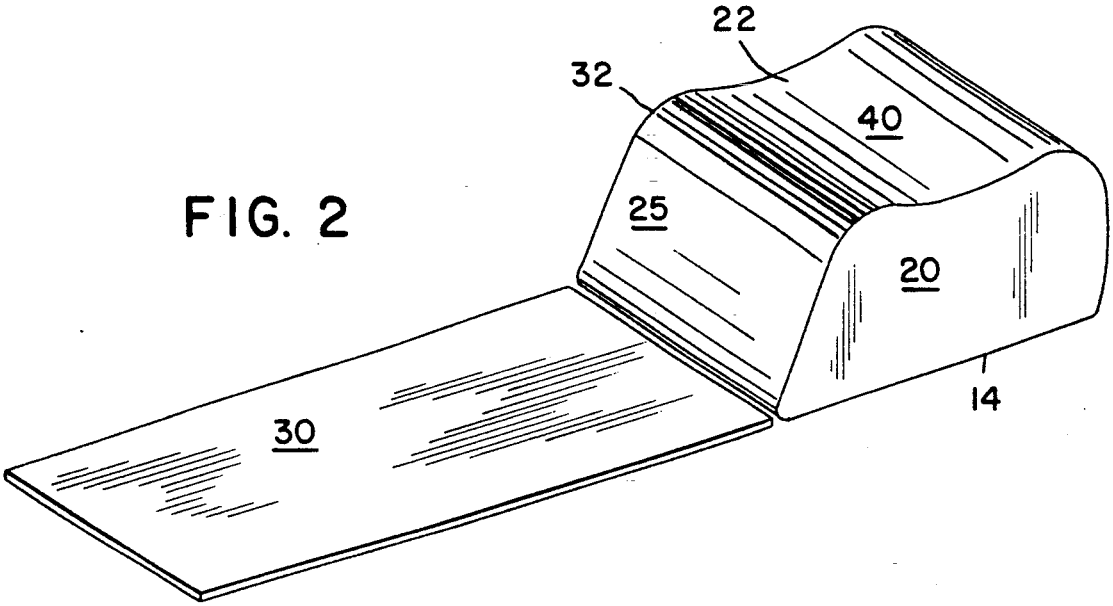
Figure 3:
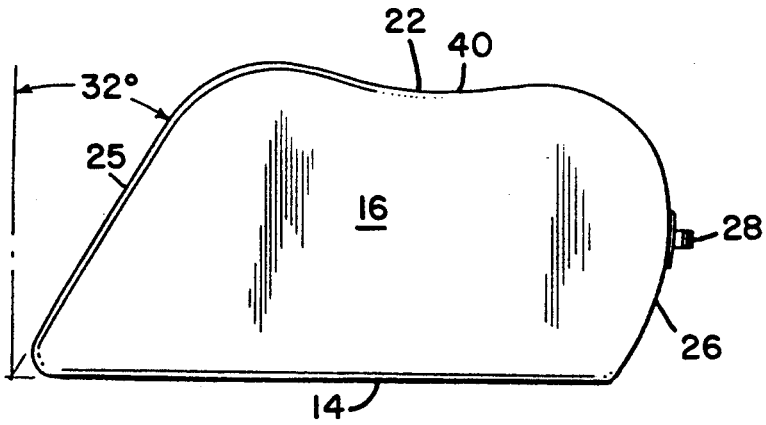
Figure 4:
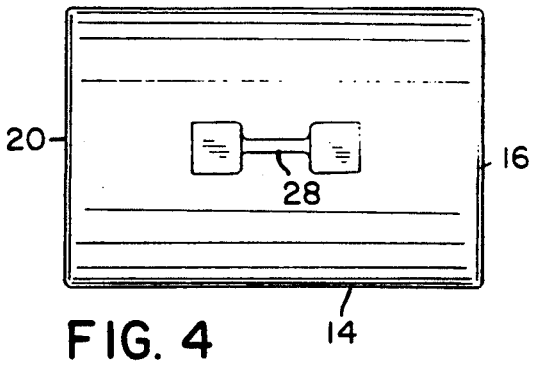
Figure 5:
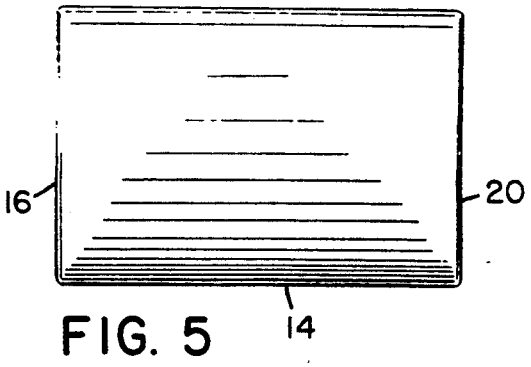
Figure 6:
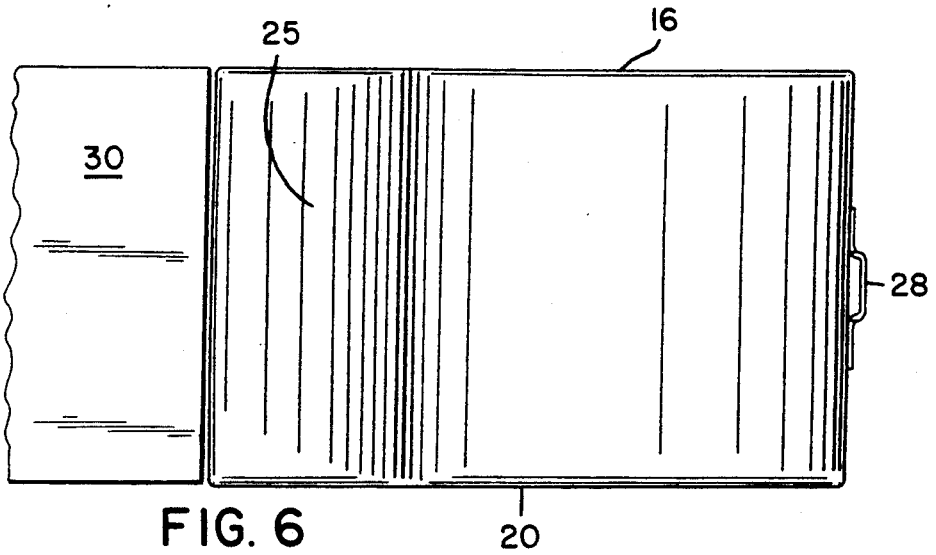

Referring now to the drawings wherein like elements indicate like parts, the numeral 10 indicates the leg support member of this invention. The support 10 is comprised of a relatively rigid foam rubber block covered by a washable fabric.

The device is formed by a bottom 14, vertical longitudinal sidewalls 16 and 20, a top surface 22, a front inclined surface 25, and a rear surface 26. Handle 28 is attached to the rear surface 26 such that the device can be readily moved to a storage area when not in use.

Figure 7:
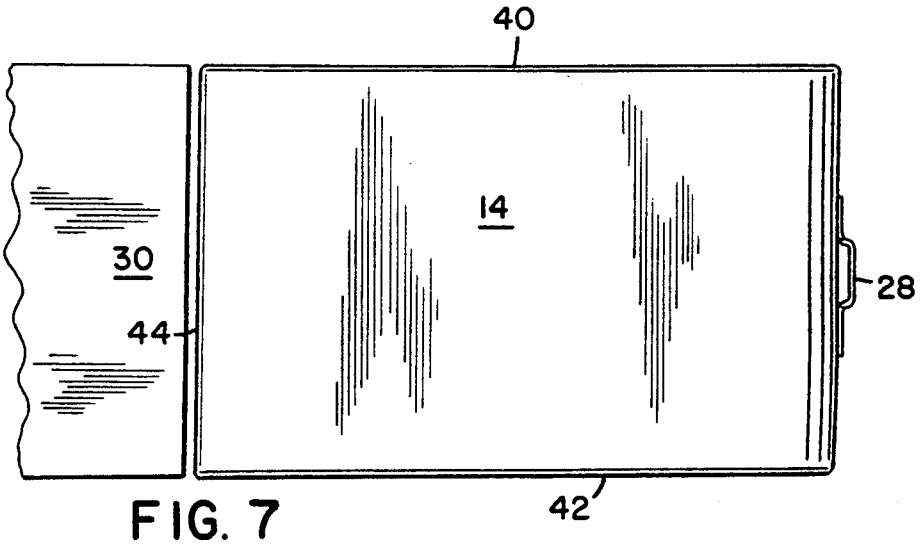

As seen in FIG. 1, the surface 25 is inclined horizontally at approximately 32 degrees. While some users may prefer a different slope, a slope too close to vertical is uncomfortable and will not support the weight of the thighs. If the slope is too shallow, the back muscles are not sufficiently relaxed. Therefore, the slope should be between 25 and 40 degrees from the vertical and preferably at 32 degrees. A one inch thick pad 30 is used with the invention where desired. As seen in FIG. 7, the bottom 14 of support 10 is defined by longitudinal edges 40 and 42, a front edge 44 and a rear edge 46.

FIG. 1 shows the invention in use. As seen, the user assumes the supine position with the back resting on the pad 30. The lower part of the buttocks and thighs are engaged with the inclined surface 25. The knees rest on the relatively curved corner 32 where surfaces of 22 and 25 merge. The surface 22 has a longitudinal length permitting the heel of the user to rest comfortably on the curved corner 36 where rear surface 26 and the horizontal 22 merge. Note that there is a gentle curve at corner 36 so that the heel tendon area of the wearer is fully and gently supported.

It should be noted that the top horizontal surface 22 is formed with a depression 38 extending between sides 16 and 20, and intermediate the curved corners or peaks 32 and 36, to receive and adequately support the calves of the user in a tension free manner. Thus, the lower section of the body from the buttocks to the heels are elevated and fully supported in a manner sufficient to relax the muscles of the lower back and calves.

It should be understood that the preferred embodiments of the present invention have been disclosed by way of example and that other modifications may occur to those skilled in the art without departing from the scope and spirit of the appended claims.

I claim:

1. A device for the relief of back pain of a user comprising:

a support over which the user's legs are adapted to be draped;

said support comprising:

a ground engaging bottom having first and second longitudinal edges, a front edge and a rear edge;

first and second vertical sidewalls located on opposite sides of said bottom and extending upwardly therefrom;

an inclined front surface extending upwardly from said front edge at an angle of between 25 degrees and 39 degrees from the vertical, said front surface having a length sufficient to engage the buttocks and rear thighs of the user;

a substantially horizontal top surface extending between said first and second vertical sidewalls and said front surface and having a longitudinal length sufficient to support that portion of the user's leg between the knee and the foot;

a rear sidewall extending upwardly from said rear edge and having its upper portion merging with said top surface at a first rounded corner opposite said front surface;

said inclined front surface and said horizontal top surface meeting at a second rounded corner that engages the inner area of the user's knee;

said top surface being formed with a lateral depression running between the vertical sidewalls, said depression being located between said first and second rounded corners and being sized to received and support the calves of a user.

2. The device of claim 1 wherein said support is made of foam rubber.

3. The device of claim 1 wherein a handle is secured to said rear sidewall.

4. The device of claim 1 wherein said support includes an outer washable fabric cover over a body of foam rubber.

5. The device of claim 1 wherein said inclined front surface is at an angle of approximately 32 degrees from the vertical.

6. The invention of claim 1 wherein said depression is less than 5% of the vertical height of said sidewalls.

* * * * *